US007040610B2

(12) United States Patent
Hubbard

(10) Patent No.: US 7,040,610 B2
(45) Date of Patent: May 9, 2006

(54) PUSH NUT PRESS TOOL FOR WHEELED ROLLOUT CARTS

(76) Inventor: Noah R. Hubbard, 5558 W. 800 North, Michigan City, IN (US) 46360

( * ) Notice: Subject to any disclaimer, the term of this patent is extended or adjusted under 35 U.S.C. 154(b) by 0 days.

(21) Appl. No.: 10/822,119

(22) Filed: Apr. 9, 2004

(65) Prior Publication Data

US 2005/0225019 A1 Oct. 13, 2005

(51) Int. Cl.
*B25B 11/00* (2006.01)
*B25B 1/20* (2006.01)

(52) U.S. Cl. ..... 269/267; 269/249; 29/279; 29/281.1

(58) Field of Classification Search ..... 269/267, 269/8, 43, 143, 249; 29/279, 255, 257, 281.1
See application file for complete search history.

(56) References Cited

U.S. PATENT DOCUMENTS 2,549,256 A * 4/1951 Sparling ..... 269/223
4,376,331 A * 3/1983 Clark ..... 29/219
4,569,511 A * 2/1986 Bell, Jr. ..... 269/276
4,962,918 A * 10/1990 Yang ..... 269/156
6,361,034 B1 * 3/2002 Wolfe ..... 269/8
6,431,534 B1 * 8/2002 Orosz et al. ..... 269/43
2005/0225019 A1 * 10/2005 Hubbard ..... 269/267

* cited by examiner

*Primary Examiner*—Lee D. Wilson
(74) *Attorney, Agent, or Firm*—R. Tracy Crump

(57) ABSTRACT

The press tool includes a frame, an abutment part mounted to one end of the frame, and a lever actuated ram mounted to the other end of the frame. The ram includes a pair of interchangeable fittings (one for affixing the push nuts and one for removing the push nuts). Rocker plates pivotally connect the rams to a long lever, which extends and retracts the ram through a tubular sleeve mounted to the frame. The assembly fitting includes a magnet that holds a push nut to the ram. When the lever is depressed, the ram extends and the push nut is pressed axially onto the axle rod. The removal fitting has a two pronged head. When the lever is depressed, the prongs deform the push nut flange, which bends back the teeth that secure the push nut to the axle.

6 Claims, 21 Drawing Sheets

PUSH NUT PRESS TOOL FOR WHEELED ROLLOUT CARTS

This invention relates to a press tool for assembling wheeled rollout carts, and in particular a press tool for affixing push nuts to axle rods and removing push nuts from axle rods.

BACKGROUND OF INVENTION

Wheeled rollout carts, such as the carts manufactured by Toter Incorporated of Statesville, N.C., are widely used for automated curbside waste and recycling collection by cites and private waste haulers. Wheeled rollout carts have been used since the 1960s. Rollout carts have a simple construction, large rugged plastics bins with plastic wheels secured to axle rods by push nut fasteners.

While convenient inexpensive fasteners, the use of push nut fasteners creates both assembly and disassembly problems for wheeled rollout carts. Typically, rollout carts are assembled by hand with the push nuts pounded onto the axle rods with a hammer. Often the push nuts are not affixed on the axles squarely. If not pressed onto the axle ends squarely, the push nuts may pop off. Improperly seated push nuts is a common problem for wheeled rollout carts. Push nuts are also difficult to remove once pressed onto the axle. The teeth formed in the capped head of the push nut allow the nut to be pressed linearly onto the axle, but prevent the nut from sliding back off the axle. Consequently, push nuts must be pried, cut or ground off the cart axle rods. Often the easiest method for removing push nuts is to grind them off the axle rod, but none of these methods are quick and effortless.

While complex automated assembly equipment has been made, which can press push nuts onto axles, such equipment is impractical and costly for the simple assembly of wheeled rollout carts. Automated equipment relies on hydraulic and pneumatic presses or electrically powered solenoids to install push nuts. While effective in purely manufacturing settings, automated equipment are not well suited for the assemble and disassembly of rollout carts, which is often done in the field where a hand operated tool is most convenient and effective. Moreover, automated assembly equipment is designed only to affix the push nuts, not remove them from the axles. A simple hand operated tool is needed for the assembly and disassembly of wheeled rollout carts that can both affix push nuts to axle rods and remove push nuts from axle rods.

SUMMARY OF INVENTION

The press tool of this invention can be used for both the assembly and disassembly of wheeled rollout carts. The press tool of this invention has two separate embodiments: a hand held press tool and a floor standing press tool. Both embodiments used a lever actuated ram mechanism, which can be used to affix push nuts onto the axle rods or remove push nuts from the axle rods. The press tools of this invention have interchangeable components, so that a user can quickly and easily move between assembly and disassembly operations.

Both embodiments of the press tool include a frame, an abutment part mounted to one end of the frame, and a lever actuated ram mounted to the other end of the frame. The ram includes a pair of interchangeable fittings (one for affixing the push nuts and one for removing the push nuts). Rocker plates pivotally connect the rams to a long lever, which extends and retracts the ram through a tubular sleeve mounted to the frame. The assembly fitting includes a permanent magnet that holds a push nut to the ram. When the lever is depressed, the ram extends and the push nut is pressed axially onto the axle rod. The removal fitting has a two pronged head. When the lever is depressed, the prongs deform the push nut flange, which bends back the teeth that secure the push nut to the axle.

Accordingly, an advantage of the press tools of this invention is that they reduce the time and effort required to fix and remove push nuts from the axle rods of rollout carts.

Another advantage of the press tools is that the ram mechanism ensures that push nuts are properly fixed to the axle rods of a rollout cart.

Another advantage of the press tools is that one or both the push nuts can be affixed to the axle rod with a single operation of the ram mechanism.

Another advantage is that the press tool can be converted from an assembly tool to a disassembly tool by simply changing out interchangeable ram components.

Another advantage is that the press tools can be operated with one hand.

Other advantages will become apparent upon a reading of the following description.

BRIEF DESCRIPTION OF THE DRAWINGS

The preferred embodiments of the invention have been depicted for illustrative purposes only wherein.

DESCRIPTION OF THE PREFERRED EMBODIMENT

The preferred embodiments herein described are not intended to be exhaustive or to limit the invention to the precise form disclosed. They are chosen and described to explain the invention so that others skilled in the art might utilize its teachings.

The push nut press of this invention is used to assemble and disassemble wheeled rollout carts, such as, the carts manufactured by Toter Incorporated of Statesville, N.C. Two separate embodiments of the press tool are described below: a floor stand embodiment and a hand held embodiment. Each embodiment includes a lever actuated ram mounted to a hand held or floor standing frame. While the press tools are manually operated by a lever connected to the ram by a simple linkage, the ram can also be actuated hydraulically, pneumatically or electrically using a simple solenoid within the teaching. Nevertheless, the simply lever actuated ram is the most practical and reliable design for use in the field and in mass quantity assembly and disassembly runs. The press tools also includes several detachable assembly and disassembly component parts. The detachable components are designed to be readily interchanged so that a user can quickly and easily move between assembly and disassembly operations.

Figure 1:
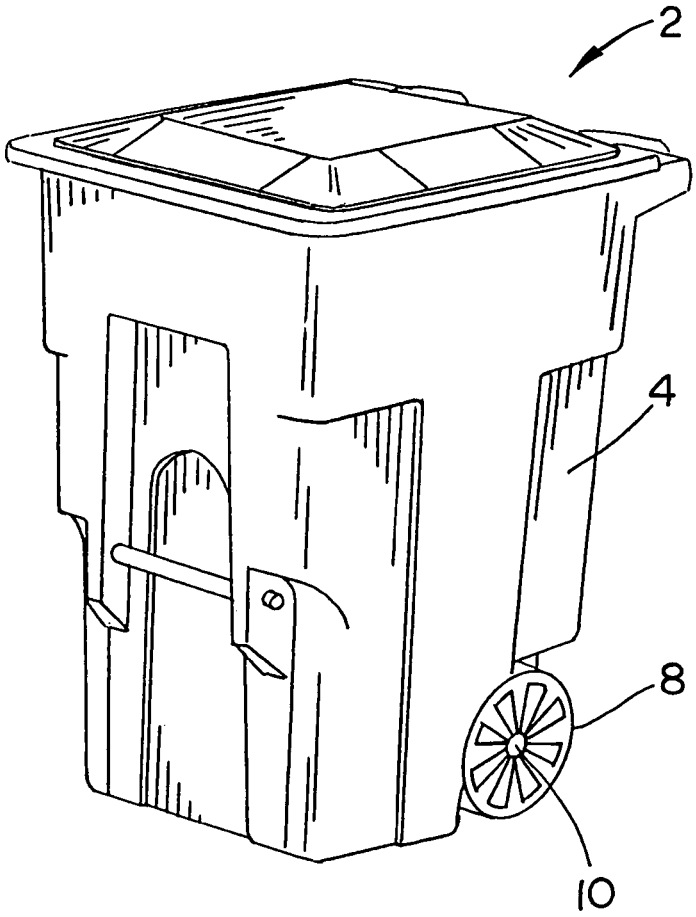
FIG. 1 is a perspective view of a conventional wheeled rollout cart.
Figure 2:
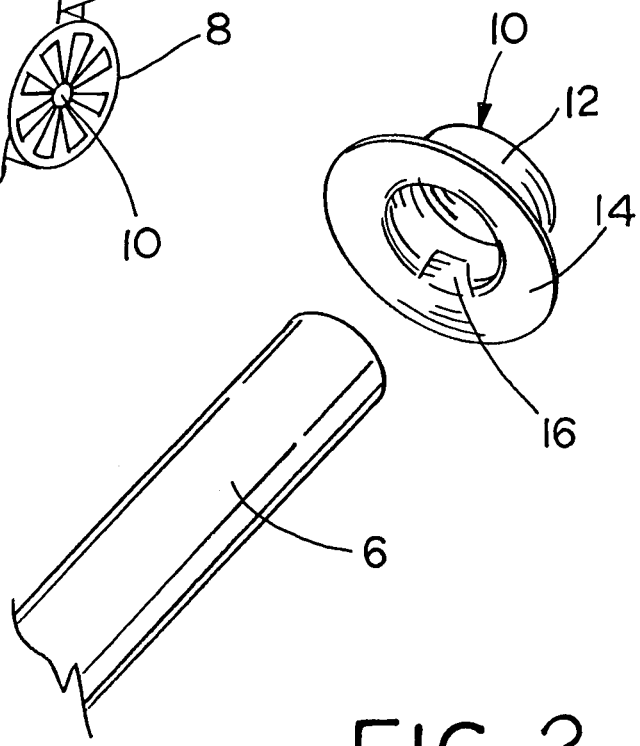
FIG. 2 is a partial perspective view of a push nut and axle rod used on a conventional rollout cart.
Figure 3:
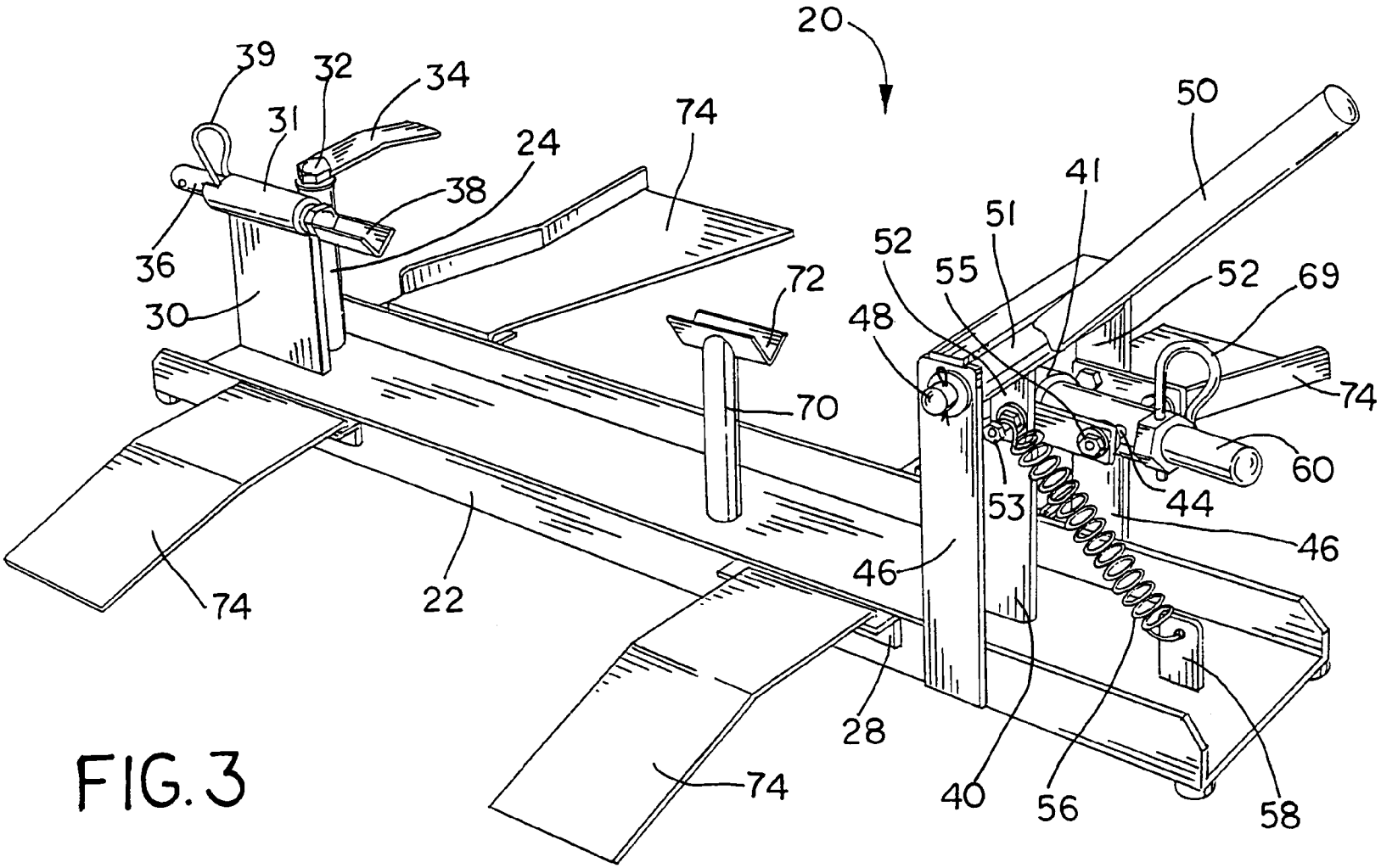
FIG. 3 is a perspective view of the floor standing embodiment of the press tool of this invention.
Figure 4:
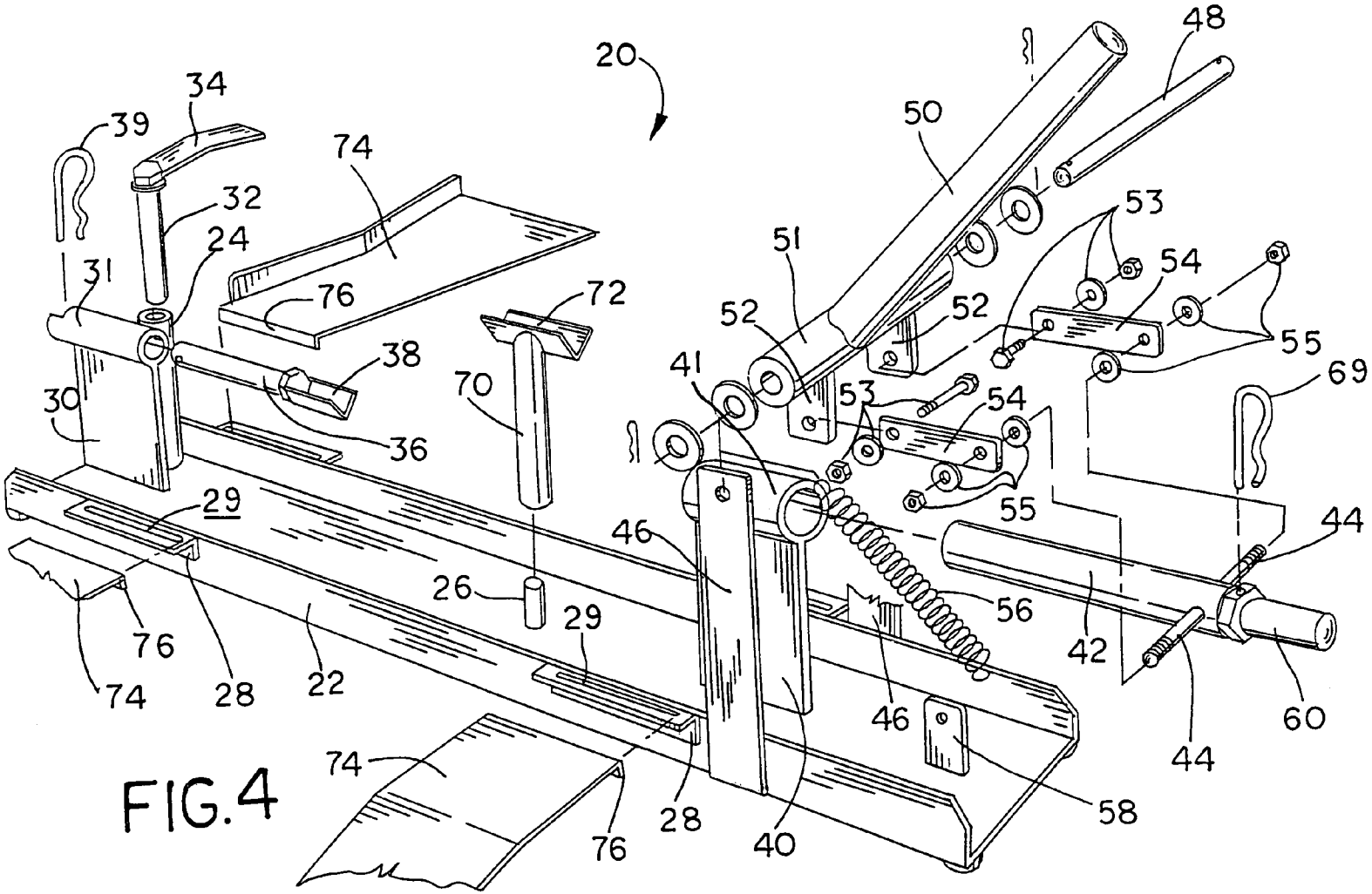
FIG. 4 is an exploded view of the hand held press tool of FIG. 3.
Figure 5:
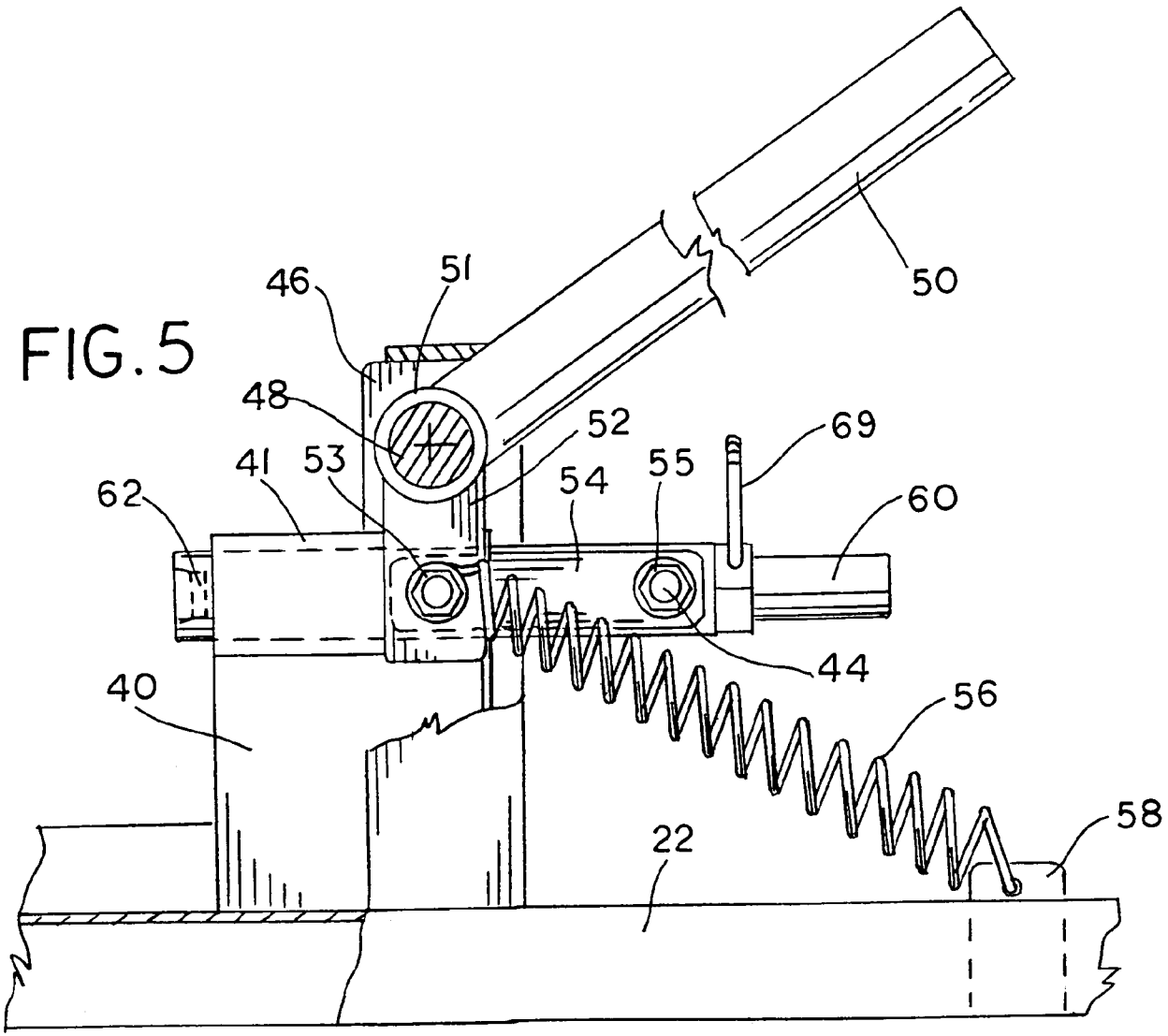
FIG. 5 is a side view of the ram mechanism of the press tool of FIG. 3 in a retracted position.
Figure 6:
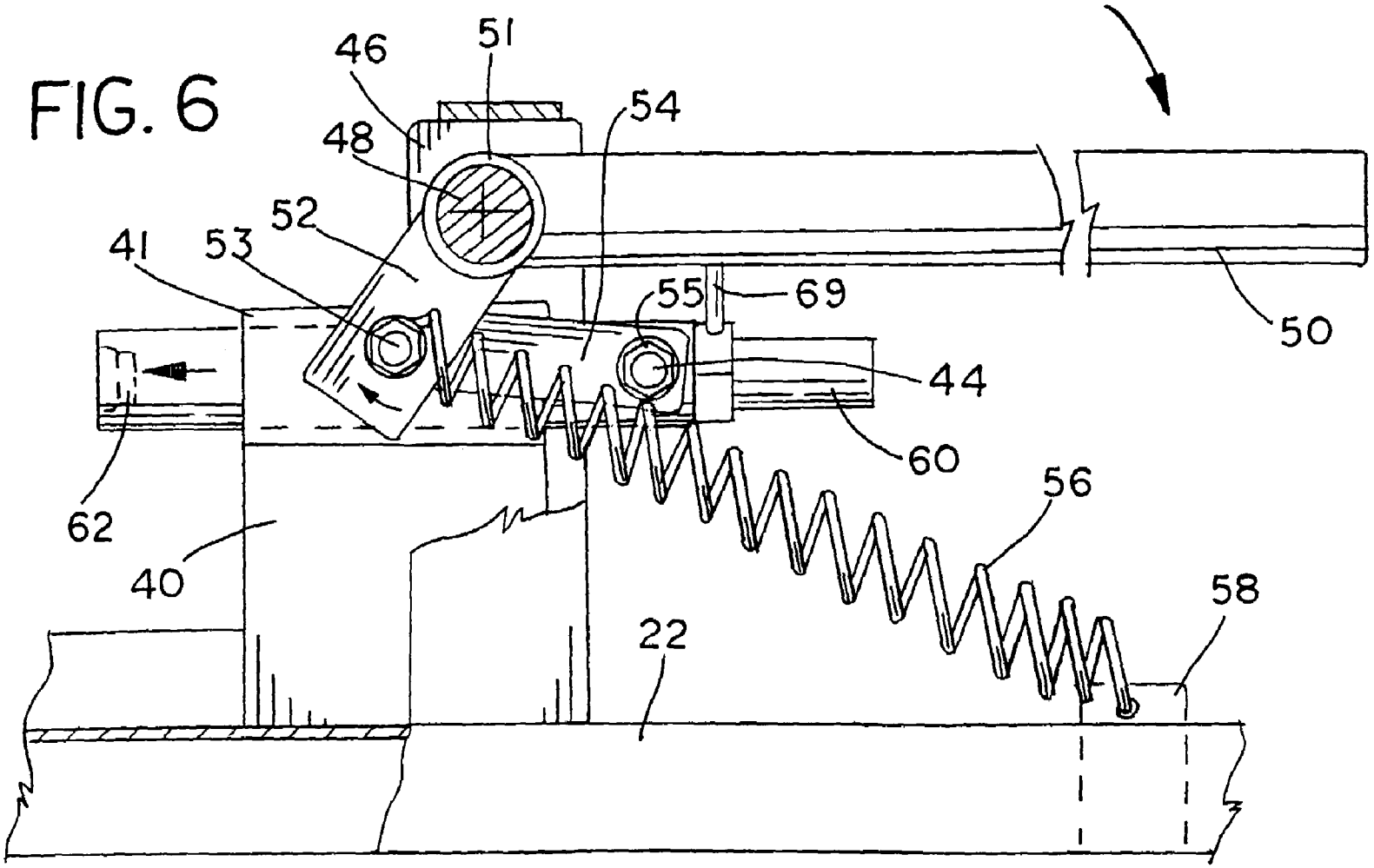
FIG. 6 is a side view of the ram mechanism of the press tool of FIG. 3 in an extended position.

FIG. 1 shows a typical wheeled rollout cart (designated generally in the figures as reference numeral 2). As shown, rollout carts 2 include a plastic cart body or bin 4, an axle rod 6, and a pair of wheels 8 secured to the axle rods by push nut fasteners 10. Push nuts are well known in the art and exist in many styles, configurations, sizes and types. FIG. 2 illustrates a common type of push nut used on rollout carts, which is known as a "pal nut." Push nuts, particularly pal nuts are typically stamped metal pieces, but may be formed of plastic or other materials. As shown, push nut 10 has a cylindrical head or cap 12 and an annular flange 14. Push nut 10 also has a pair of teeth 16, which is stamped or cut where the flange curves in cap 12. Teeth 16 are stamped or cut into the material of the nut where the flange 14 curves into cap 12 so that the teeth protrude inward at a slight angle.

Floor Stand Embodiment

Figure 8:
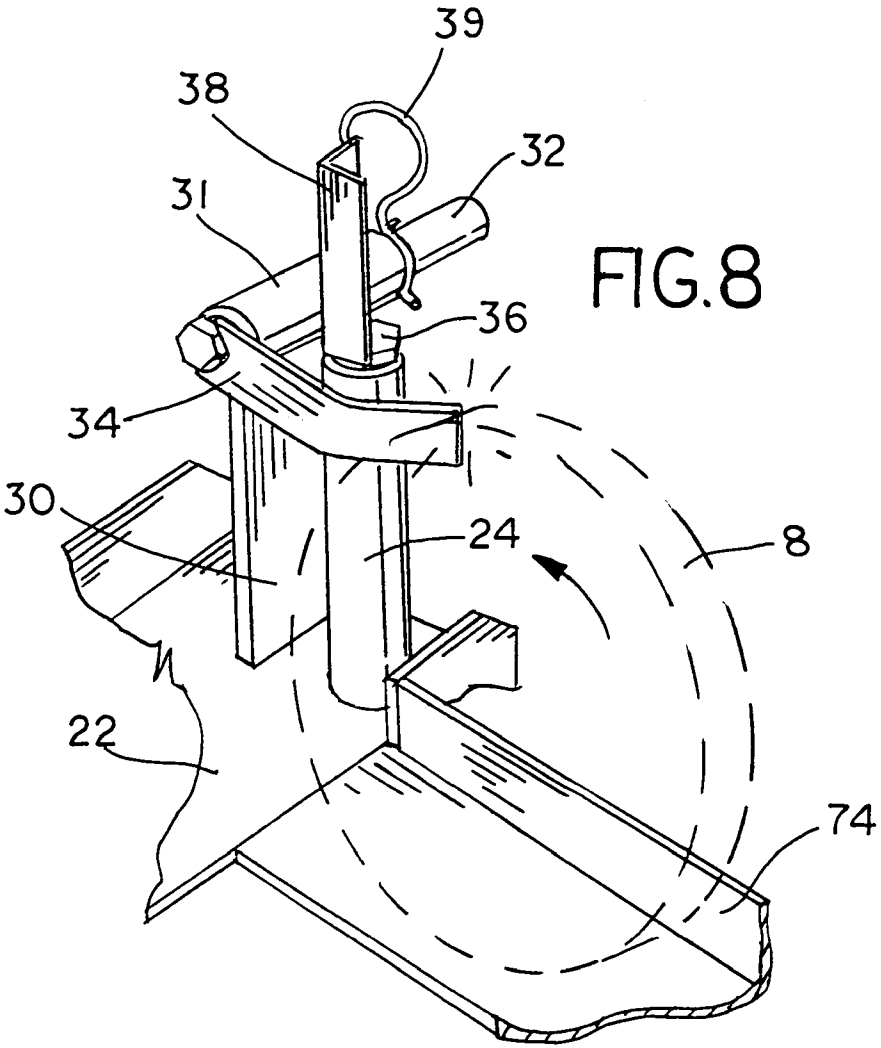
FIG. 8 is a partial perspective view of the abutment support of the press tool of FIG. 3 fitted with the other of the stop heads.
Figure 7:
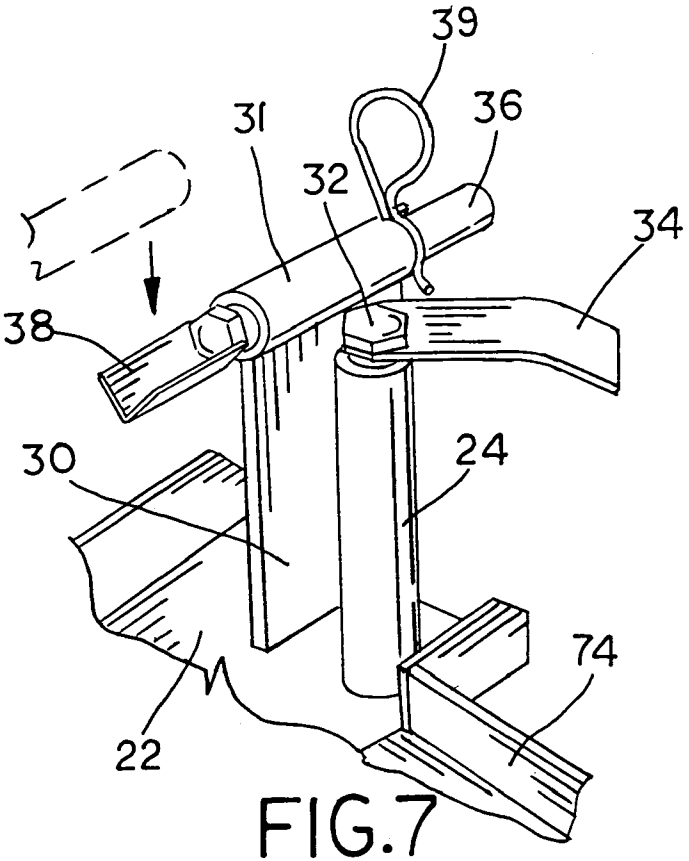
FIG. 7 is a partial perspective view of the abutment support of the press tool of FIG. 3 fitted with one of the stop heads.

FIGS. 3–20 illustrates the floor standing embodiment of the push nut press of this invention, which is designated generally as reference numeral 20. Press 20 includes a floor standing frame 22, which is a long section of metal U-channel. An abutment support 30 extends upward from one end of floor stand 22 and includes a tubular sleeve 31 for interchangeably receiving one of two stop fittings 32 or 36. As best shown in FIGS. 7 and 8, each stop fitting 32 and 36 has a shaft that extends into stop sleeve 31 and is secured by a cotter pin 39. As shown, stop fitting 32 has a flat guide 34 and stop fitting 36 has a V-shaped axle tray 38. Frame 22 also includes an upright tubular sleeve 24 for storing one of stop fittings 32 and 36 when not affixed to abutment support 30.

A ram support 40 extends upward from frame 22 opposite abutment support 30. Ram support 40 has a tubular sleeve 41 for reciprocally receiving a ram slide 42. Ram slide 42 has a long tubular body designed to accept either an assembly fitting 60 or a removal fitting 64. Ram slide 42 also includes two laterally extending threaded studs 44. A lever 50 is pivotally connected between two uprights 46 that extend from the sides of frame 22. A lever axle 48 extends through a tubular cross member 51 welded at the end of lever 50 and is secured by cotter pins 49. Lever 50 includes a pair of lever arms 52 that extend from cross member 51. A pair of rocker plates 54 pivotally connect lever arms 53 and ram slide 42, which form a linkage mechanism for reciprocally extending and retracting the ram slide through ram sleeve 41. One end of each rocker plate 54 is pivotally connected to lever arms 52 by bolts, washers and hex nuts (referred to herein and designated in the figures collective as fasteners 53). The other end of rocker plate 54 is pivotally connected to ram slide 42 on slide studs 44 and secured by washers and hex nuts (referred to herein and designated in the figures collectively as fasteners 55). A helical return spring 56 is connected between ram slide 42 and a spring mount 58, which extends upward from frame 22. As shown best in FIGS. 5 and 6, depressing lever 50 extends ram slide 42 through sleeve 41 towards abutment support 30. Return spring 56 applies force to the extended ram slide to retract the ram slide.

Figure 19:
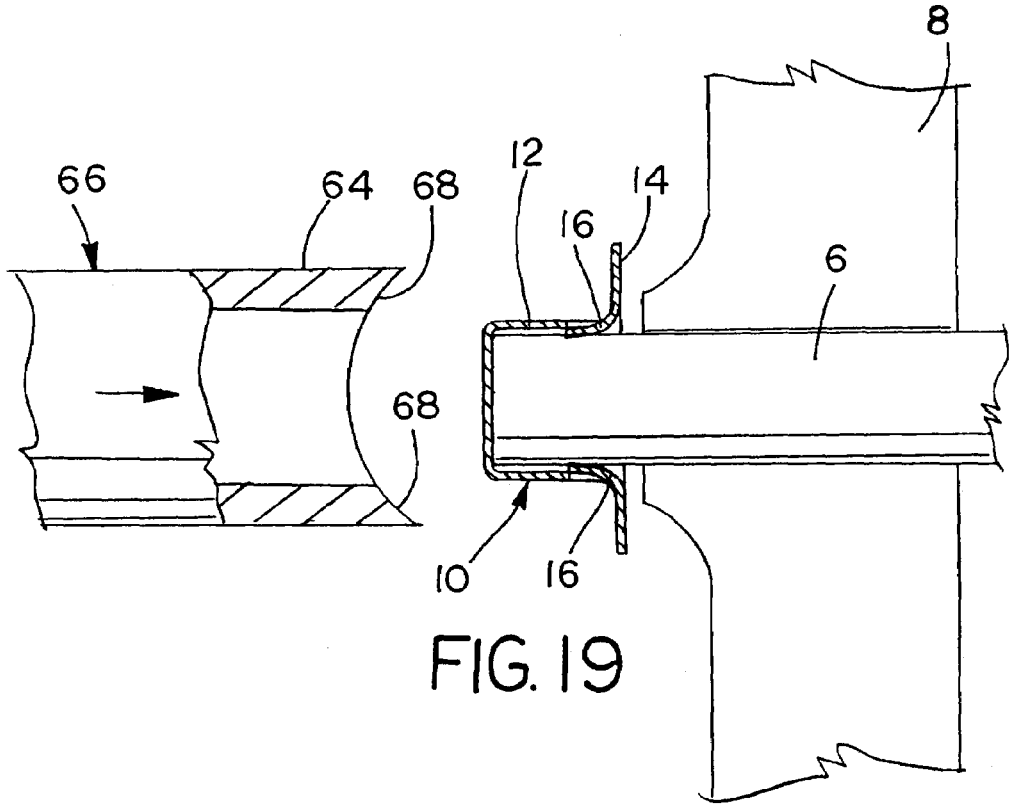
FIG. 19 is a partial sectional view of the removal head of the press tool of this invention and a push nut mounted to an axle rod.
Figure 20:
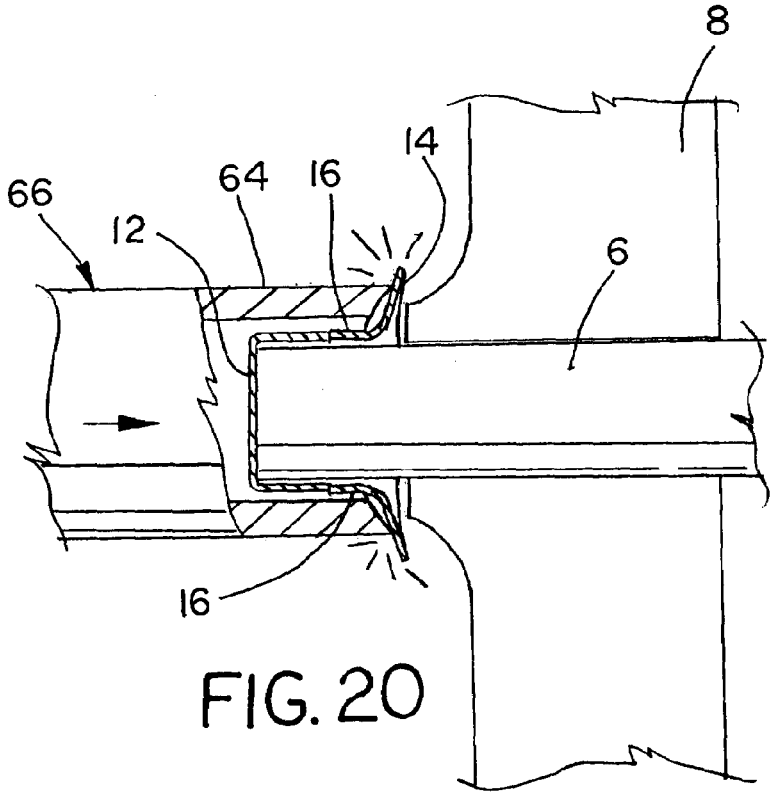
FIG. 20 is a partial sectional view of the removal head of the press tool of this invention pressed against a push nut mounted to an axle rod.
Figure 21:
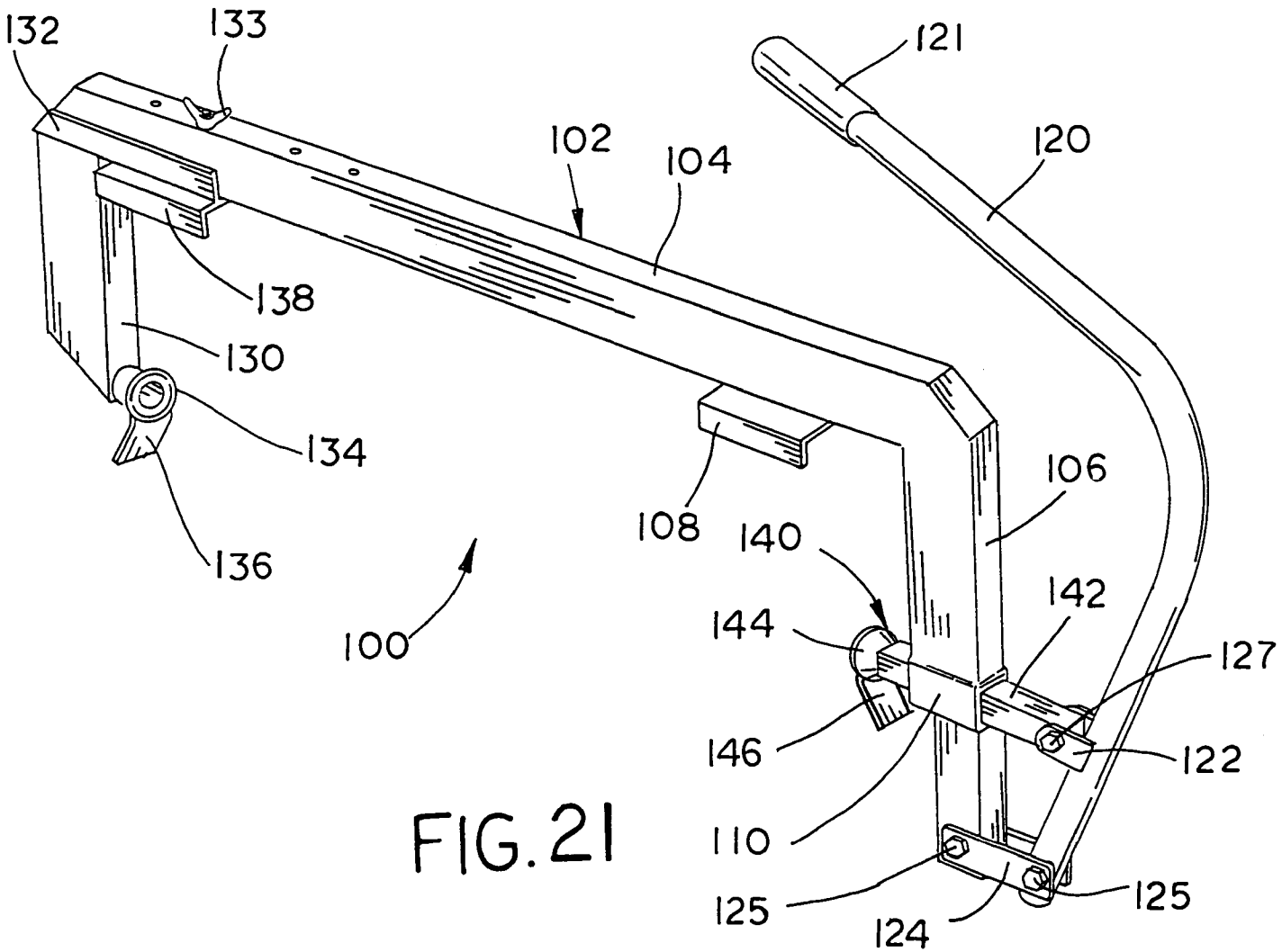
FIG. 21 is a perspective view of the hand held embodiment of the press tool of this invention.
Figure 22:
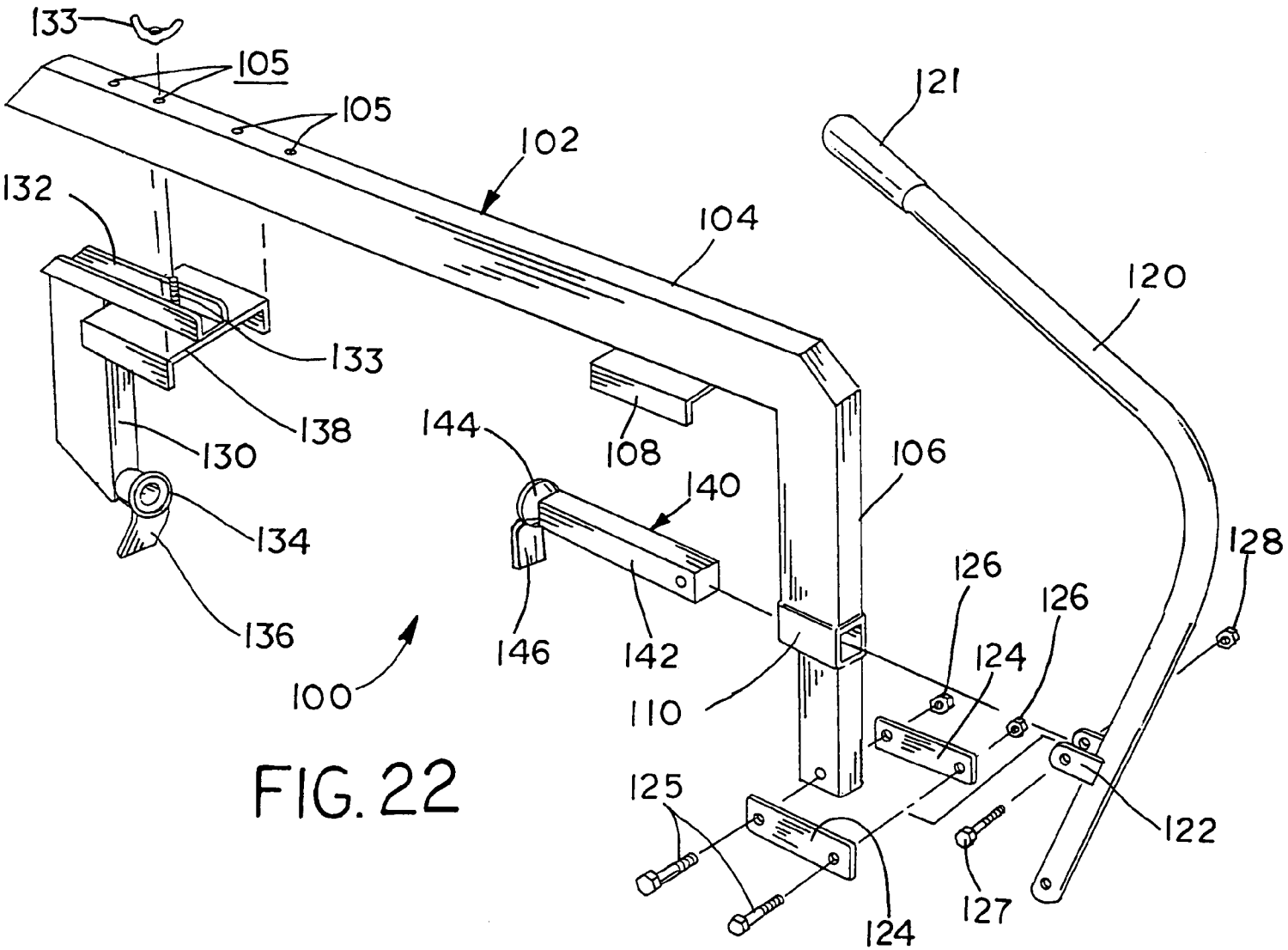
FIG. 22 is an exploded view of the hand held press tool of FIG. 21.

Assembly fitting 60 is a long shank with a magnet 62 mounted to one end for holding push nuts 10 as they are pressed onto axle rods 6. When assembly fitting 60 is mounted within ram slide 42, magnet 62 is inset from the end of the ram slide so that a push nut can be seated within the end of the ram slide and securely held by the magnetic field. As best shown in FIGS. 19 and 20, removal fitting 64 also has a long shank, but also has a specialized end 66 for removing the push nuts from the axle rods. As shown, specialized end 66 has a tubular cross section with the sides cut down to form two prongs 68. Both fittings 60 and 64 are secured within ram slide 42 by a cotter pin 69 that extends through aligned lateral bores in the fittings and the ram slide.

Press tool 20 also includes a detachable tubular axle support 70 and two pairs of ramps 74. Axle support 70 has a V-shaped tray 72, upon which axle rod 6 is seated. When in use, axle support 70 is mounted to a post 26 that extends from frame 22. When not in use, axle support 70 is mounted to a second storage post (not shown) extending from frame 22 for convenient storage. Ramps 74 are fitted to frame 22 by four slotted ramp brackets 28 that are welded to the sides of frame 22. Each ramp 74 has an end flange 76, which seats within a long slot 29 formed in ramp bracket 28.

Figure 9:
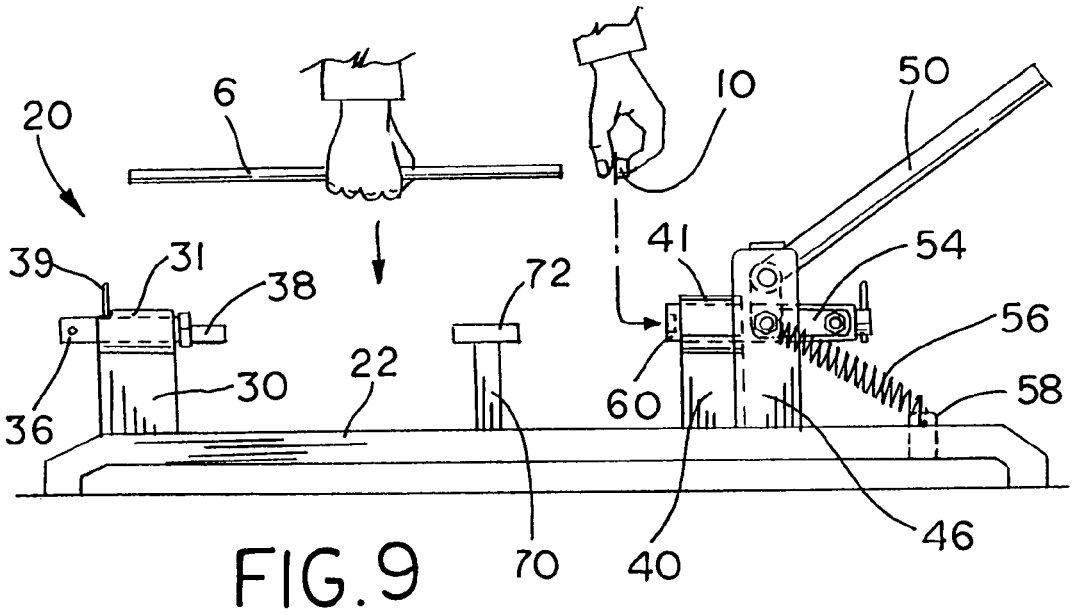
FIGS. 9 and 10 are a side view of the press tool of FIG. 3 showing an axle rod being seated between axle supports and abutment support and a push nut being inserted into the assembly ram slide.
Figure 10:
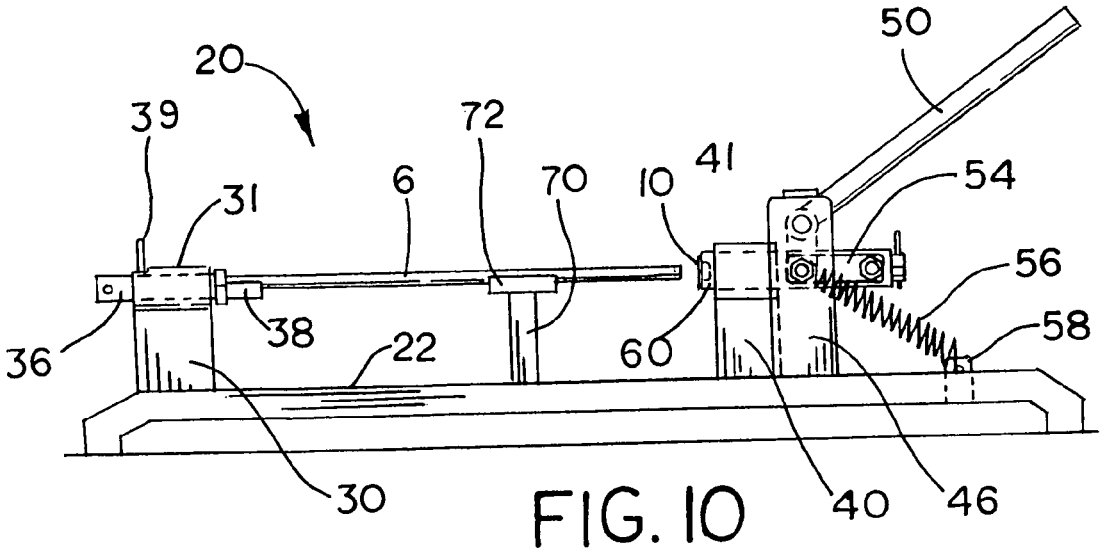
Figure 11:
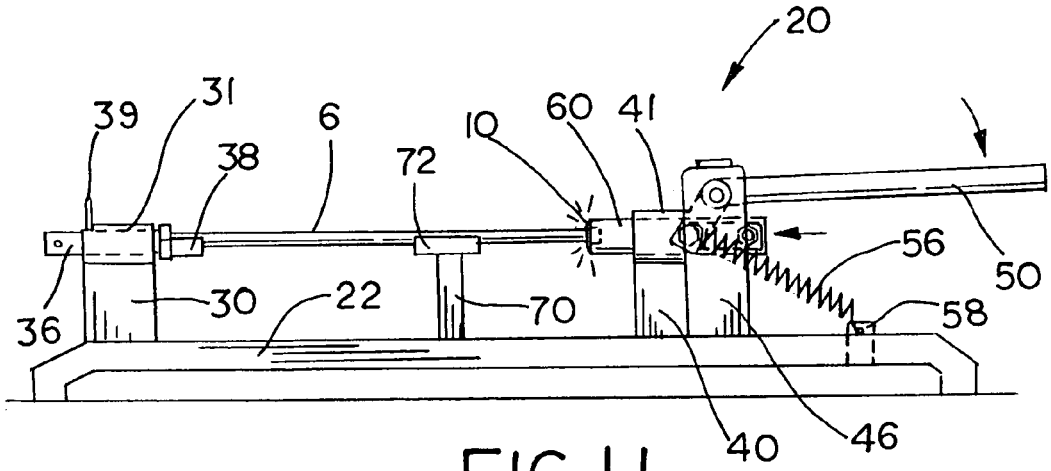
FIG. 11 is a side view of the press tool of FIG. 3 showing the lever being depressed and a push nut being driven onto the axle rod.
Figure 12:
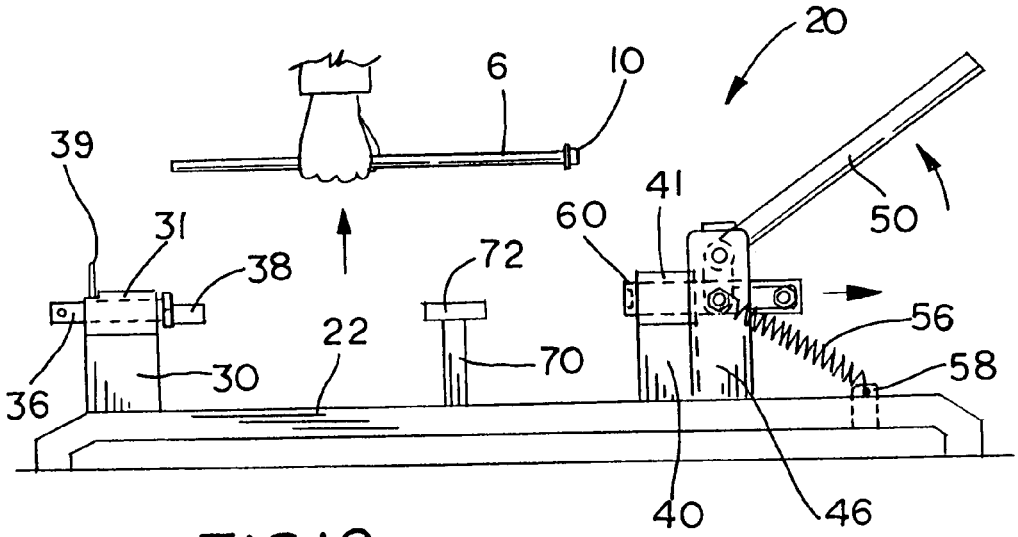
FIG. 12 is a side view of the press tool of FIG. 3 showing the partially assembled axle rod and push nut being removed from the press tool.
Figure 13:
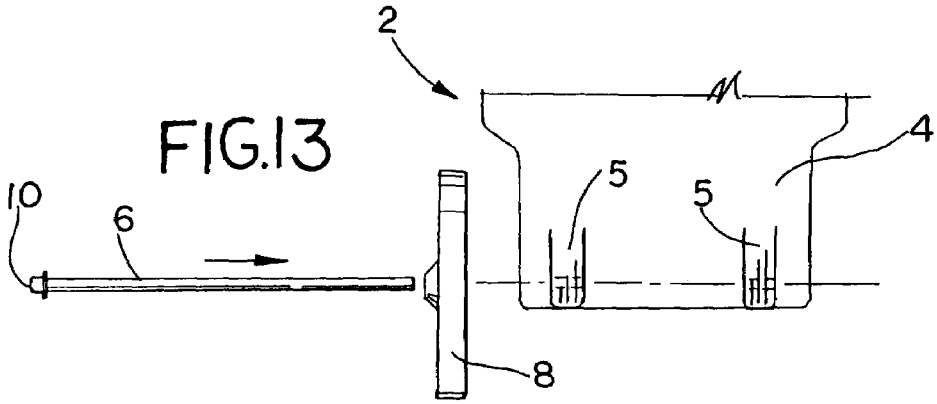
FIGS. 13 and 14 are side views of a partially assembled a rollout cart.
Figure 14:
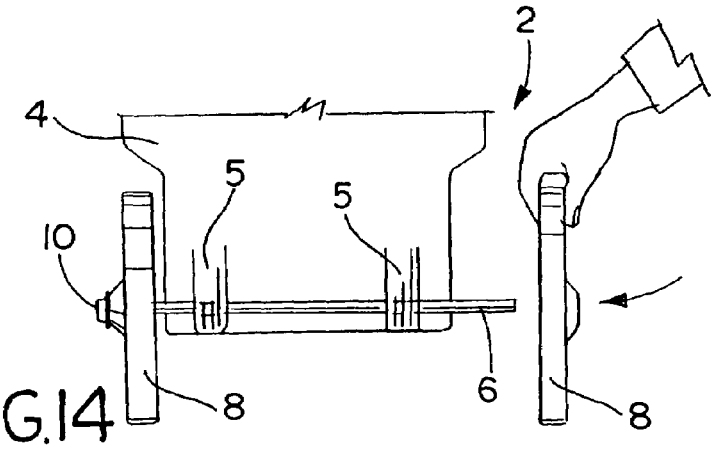
Figure 15:
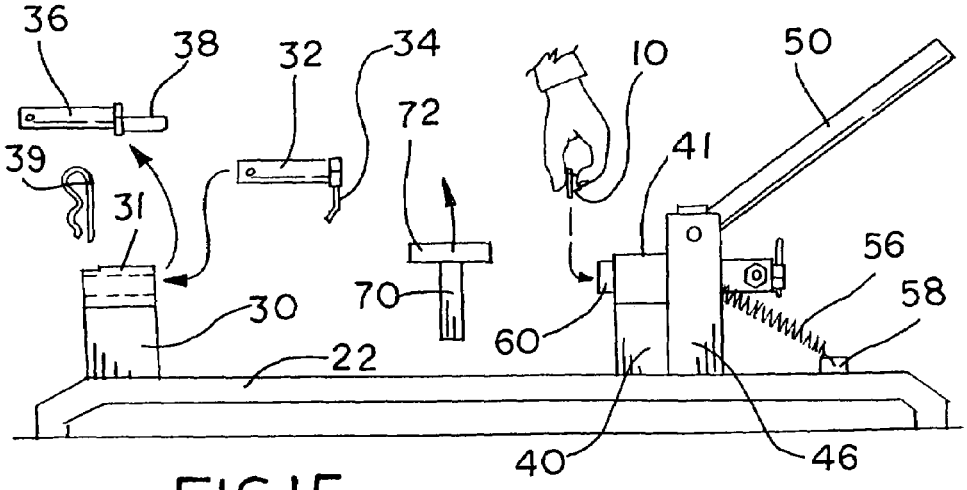
FIG. 15 is a side view of the press tool of FIG. 3 showing the replacement of the stop heads and the removal of the axle support.
Figure 16:
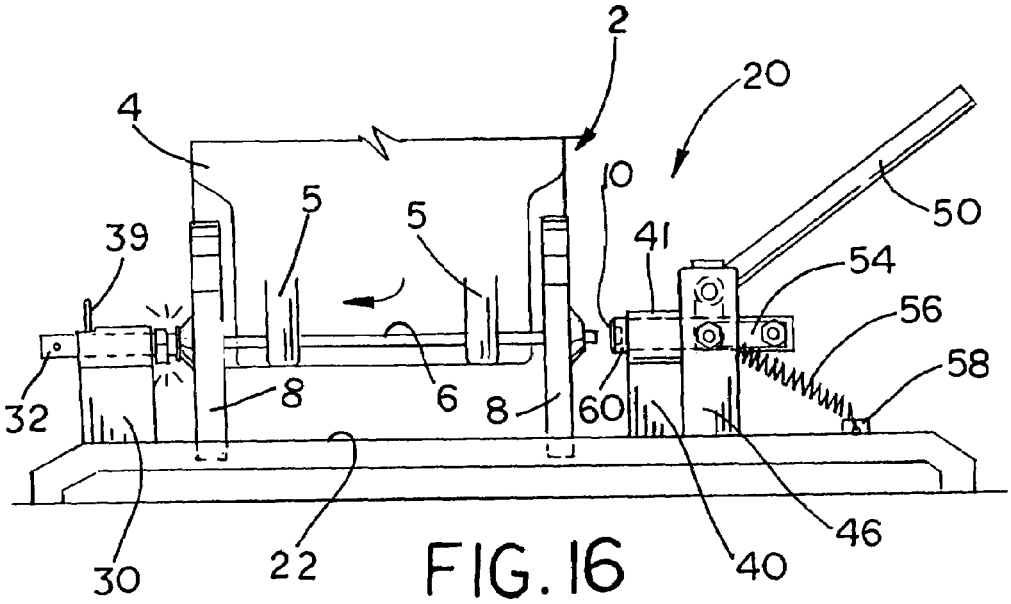
FIG. 16 is a side view of the press tool of FIG. 3 showing a partially assembled rollout cart positioned between the abutment support and ram mechanism.
Figure 17:
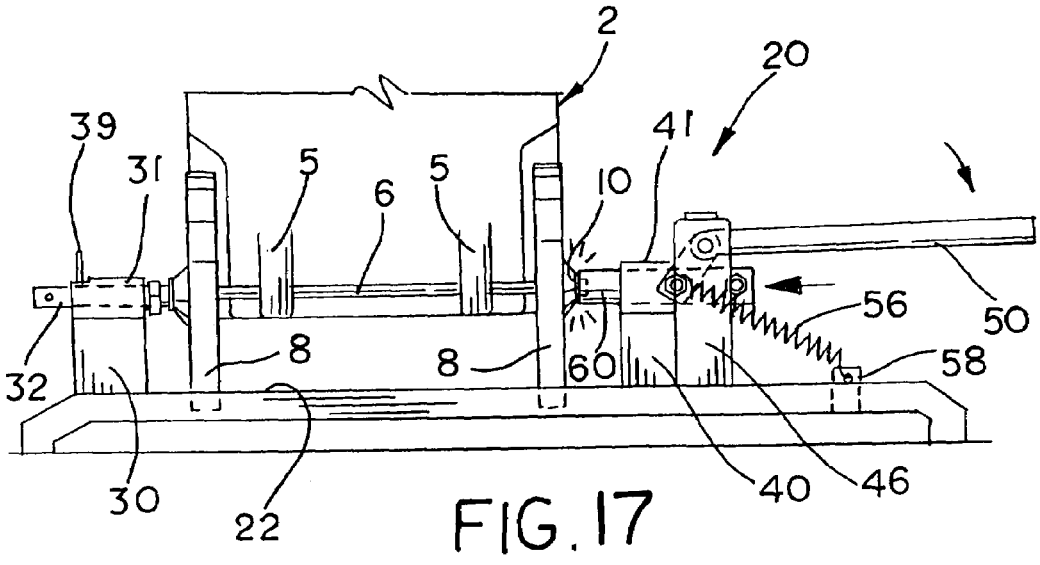
FIG. 17 is a side view of the press tool of FIG. 3 showing the lever being depressed and a push nut being driven onto the axle rod.
Figure 18:
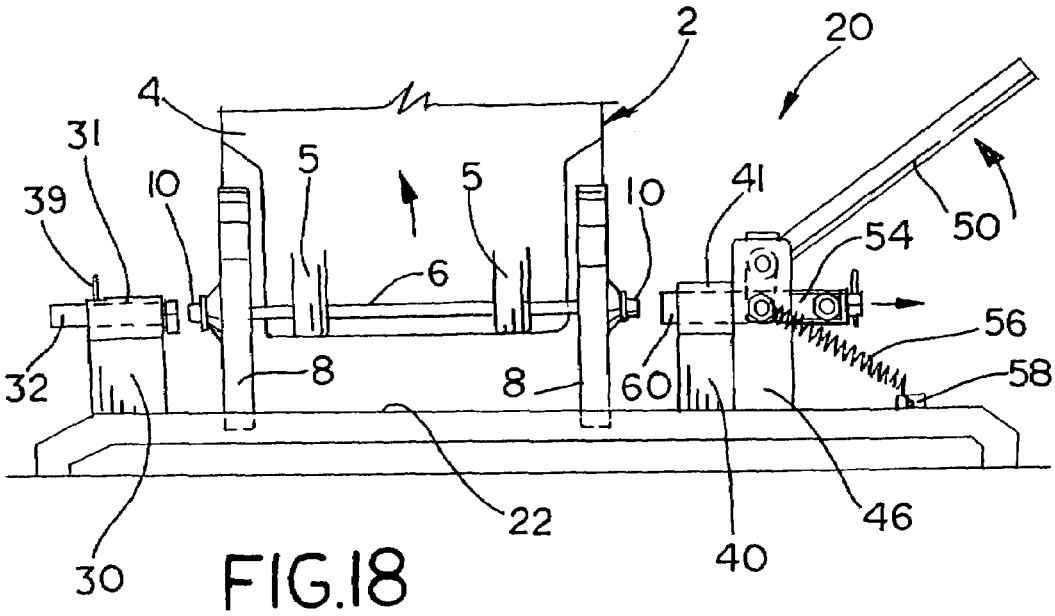
FIG. 18 is side view of the press tool of FIG. 3 showing a fully assembled rollout cart.

FIGS. 9–18 illustrate how press tool 20 is used to assemble a rollout cart 2. The first step is to press a push nut onto one end of the axle rod. As shown in FIGS. 9 and 10, press tool 20 is configured with stop head 36 fitted to abutment support 30 and axle support 70 fitted to post 26. A first push nut 10 is inserted into ram slide 42, which is held in place by magnet 62 and an axle rod 6 is placed atop trays 38 and 72 of stop fitting 36 and axle support 70. Next, lever 50 is depressed, which extends ram slide 42 pressing push nut 10 onto axle rod 6 (FIG. 11). When lever 50 is released, return spring 58 retracts ram slide 42 and axle rod 6 while the newly installed push nut 10 is removed from press tool 20 (FIG. 12). Now, the axle rod with its single push nut and wheel are manually installed onto cart body 4 (FIGS. 13 and 14). Next, press tool 20 is reconfigured install a second push nut onto the axle rod. Stop fittings 32 and 36 are interchanged and axle support 70 removed from post 26 (FIG. 15). Once the second push nut 10 is inserted in ram slide 42, the partially assembled cart 2 is rolled onto press tool 20 (FIG. 16). Ramps 74 allow the partially assembled cart to be rolled easily onto and off the press tool. Guides 34 of stop fitting 32 help center cart 2. The sides of frame 22 act as wheel chocks to prevent cart 2 from moving about and ensure proper positioning. When the cart is positioned atop press tool 20, the end of axle rod 6 abuts against stop fitting 32 and is axially aligned with ram slide 42. Once the cart is properly positioned on press tool 20, lever 50 is depressed, which extends ram slide 42 pressing the second push nut onto the axle rod (FIG. 17). Once the second push nut is secured to the axle rod, cart assembly is completed and the cart is rolled off the press tool (FIG. 18).

FIGS. 19–20 illustrate how press tool 20 is used to disassemble rollout cart 2. To disassemble cart 2, that is remove a push nut 10 from axle rod 6, press tool 20 is configures similar to that of FIGS. 15 and 16, except that assembly fitting 60 is interchanged for removal fitting 64 within ram slide 42. As shown, to remove push nut 10, cart 2 is rolled onto press tool 20 and axle rod 6 and push nut 10 are rotated so that teeth 16 of the push nut align with prongs 68 of removal head 66. When lever 50 is depressed extending ram slide 42, prongs 68 engage and deform push nut flange 14 around teeth 16, which pulls the teeth back out of engagement with axle rod 6. When lever 50 is release, push nut 10 can be manually pulled off axle rod 6 by hand with nominal force. Often, the push nut will simply fall off the axle. This process can be repeated for the other push nut as necessary.

Hand Held Embodiment

FIGS. 21–29 illustrate a hand held embodiment of the apparatus of this invention, which is designated generally as reference numeral 100. Press tool 100 is constructed of metal tubing or other material that will provide sufficient structural strength, but still allow a user to manipulate the press tool with one hand. Press tool 100 includes an L-shaped frame 102 having a long cross member 104 and a shorter leg member 106. Frame cross member 104 has a plurality of through bores 105. Frame 102 also includes a fixed wheel chock 108 and a tubular ram sleeve 110. Wheel chock 108 is a section of U-channel mounted under cross member 104 adjacent leg member 106.

As shown, ram sleeve 110 is a piece of square tube welded intermediate of leg member 106 and axially parallel with frame cross member 104. Ram sleeve 110 is designed to interchangeably receive one of two reciprocating rams: an assembly ram 140 and a removal ram 150 (described in detail below). An L-shaped lever 120 is pivotally connected at the end of frame leg member 106 by a pair of rocker plates 124. Rocker plates 124 are secured to frame leg member 106 and lever 120 by a bolt and a locking hex nut (collectively, fasteners 125). Lever 120 includes a pair of lever arms 122. Rams 140 and 150 are reciprocally journaled within ram sleeve 110 and pivotally connected to lever arms 122 by bolts and hex nuts (collectively, fasteners 127). Lever arms 122 and rocker plates 124 form a linkage for actuating rams 140 and 150. Lever 120 also includes a handle grip 121, which allows a user to hold and position press tool 100, as well as actuate the rams. Pushing lever 120 downward toward frame cross member 104 drives the ram forward through ram sleeve 110 from a retracted position to an extended position.

A shiftable abutment part 130 is connected to frame 102 at selective locations along frame cross member 104. Abutment part 130 is mounted underneath frame cross arm 104, which is restrictively seated inside a U-channel 132 and secured by a bolt and wing nut (collective fasteners 133). As shown, the bolt extends though a bore in channel 132 and through one of bores 105 in frame cross member 104, which allows abutment part 130 to be selectively positioned along the frame cross member so that the press tool can be used for carts having different axle lengths. Abutment part 130 includes a push nut cup 134 and a wheel chock 138. Push nut cup 134 is a metal cup, which is configured to receive a push nut therein. Push nut cup 124 includes a permanent magnet 135 mounted inside the cup for holding the push nuts within the cup as they are pressed onto the axle rods. Push nut cup 134 also includes a guide 136, which is used to assist the user in positioning press tool 100 over cart 2 during assembly. Wheel chock 138 is a section of U-channel mounted under U-channel 132.

Figure 28:
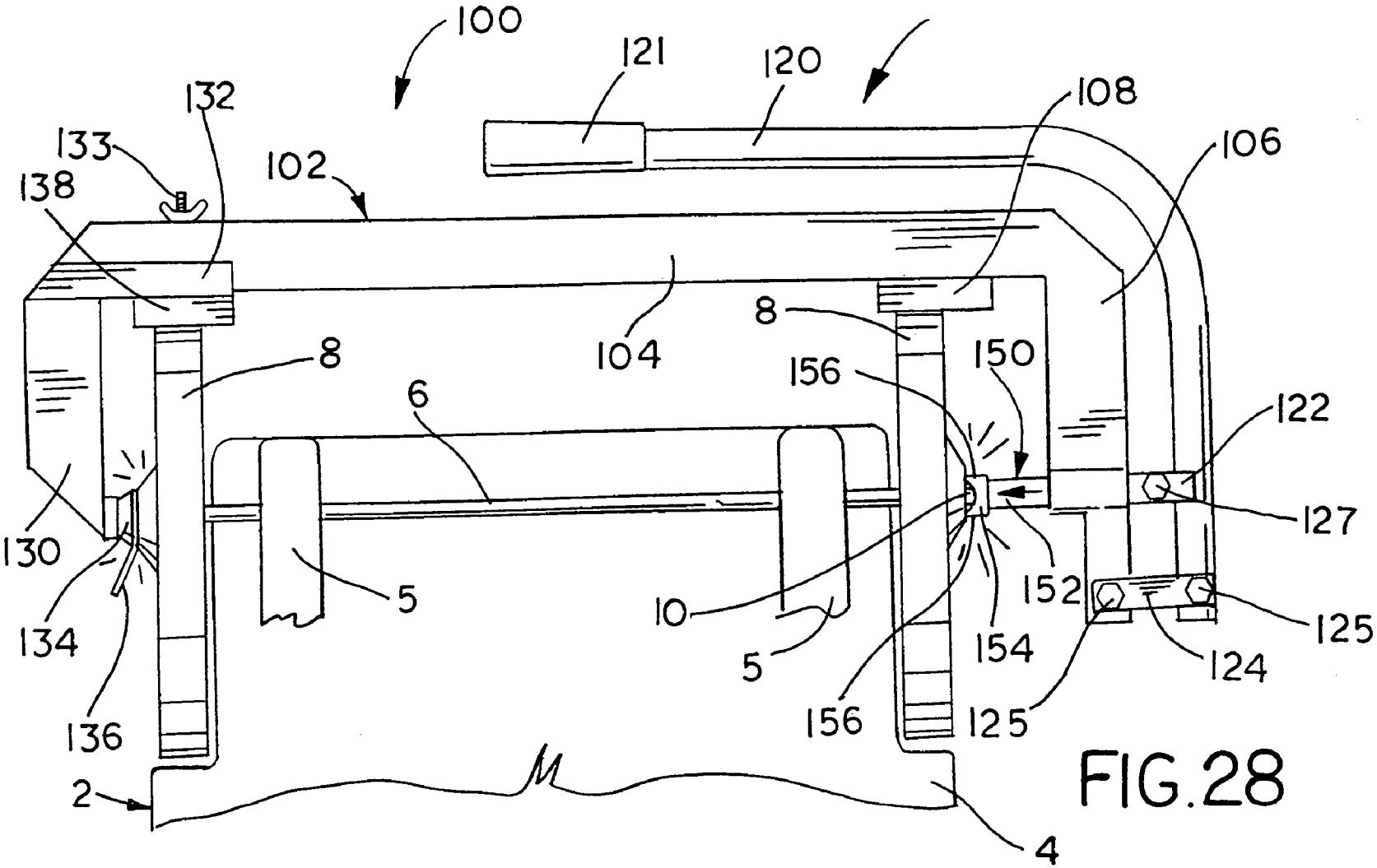
FIG. 28 is a side plan view of the hand held press tool of FIG. 21 fitted with the removal ram.
Figure 29:
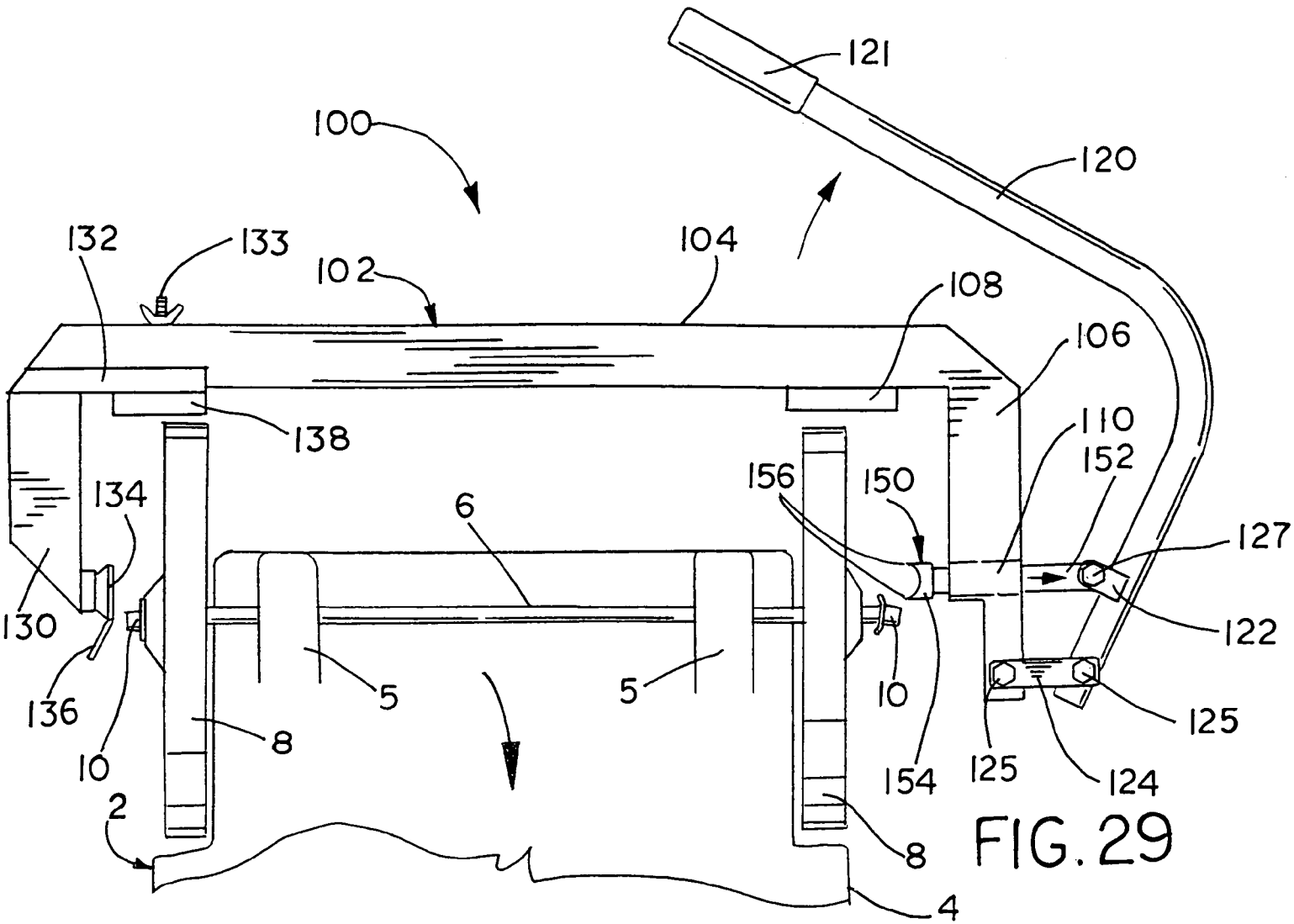
FIG. 29 is a side plan view of the hand held press tool of FIG. 21 fitted with the removal ram and positioned over a fully assembled rollout cart.

As shown, assembly ram 140 includes an elongated shank 142 constructed of heavy walled square tube and a push nut cup 144 mounted at one end of the shank. Push nut cup 144 is identical to push nut cup 134 of abutment part 130 and includes a permanent magnet 145 mounted inside the cup and a guide 146. As shown in FIGS. 28 and 29, removal ram 150 includes an elongated shank 152 and a specialized cylindrical head 154 for removing the push nuts from the axle rods. As shown, the sides of head 154 are cut down to form two prongs 156.

FIGS. 23–27 illustrate how press tool 100 is used to assemble a rollout cart. Carts 2 are partially assembled by inserting axle rod 6 through cart axle mounts 5 and wheels 8 are fitted onto the ends of axle rod 6. Typically, cart 2 is laid on its face so that axle rod 6 and wheels 8 can easily be assembled onto axle mounts 5. Lying cart 2 on its face also allows a user to position press tool 100 directly over wheels 8. Once partially assembled, press tool 100 is used to install push nuts 10 onto the ends of axle rod 6.

Figure 23:
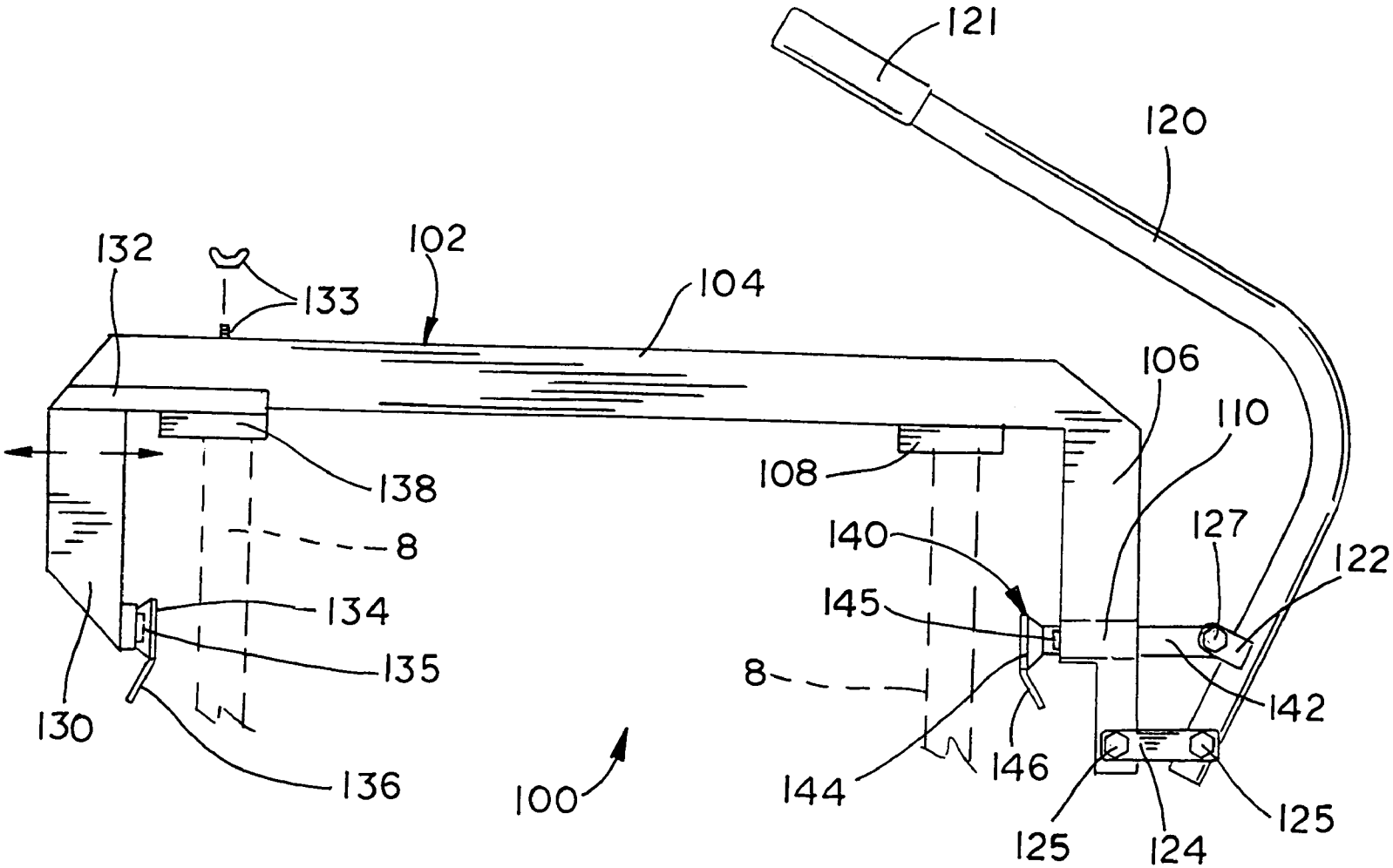
FIG. 23 is a side view of the hand held press tool of FIG. 21 fitted with the assembly ram.
Figure 24:
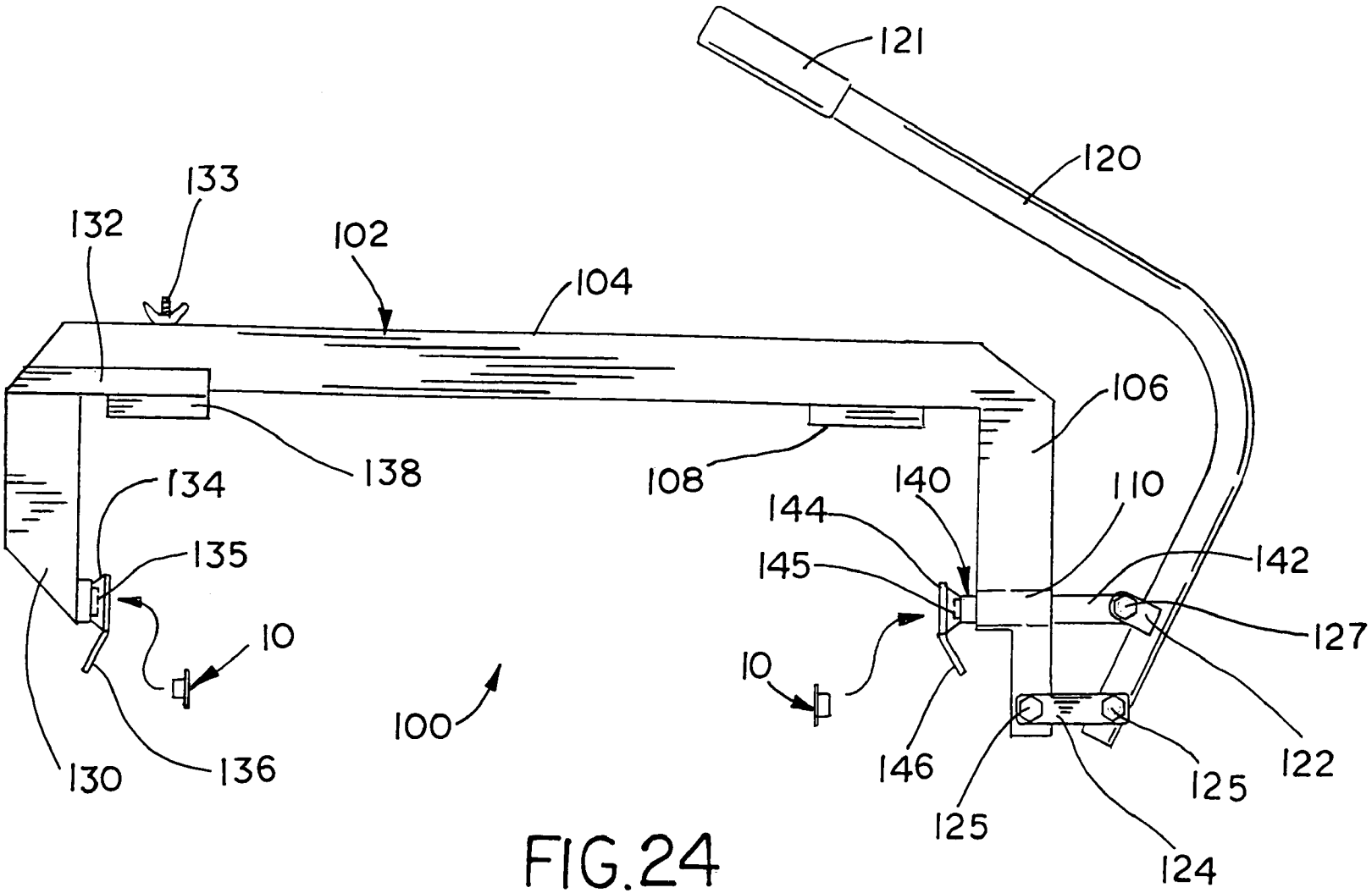
FIG. 24 is another side view of the hand held press tool of FIG. 21 showing push nuts being inserted into the push nut cups.
Figure 25:
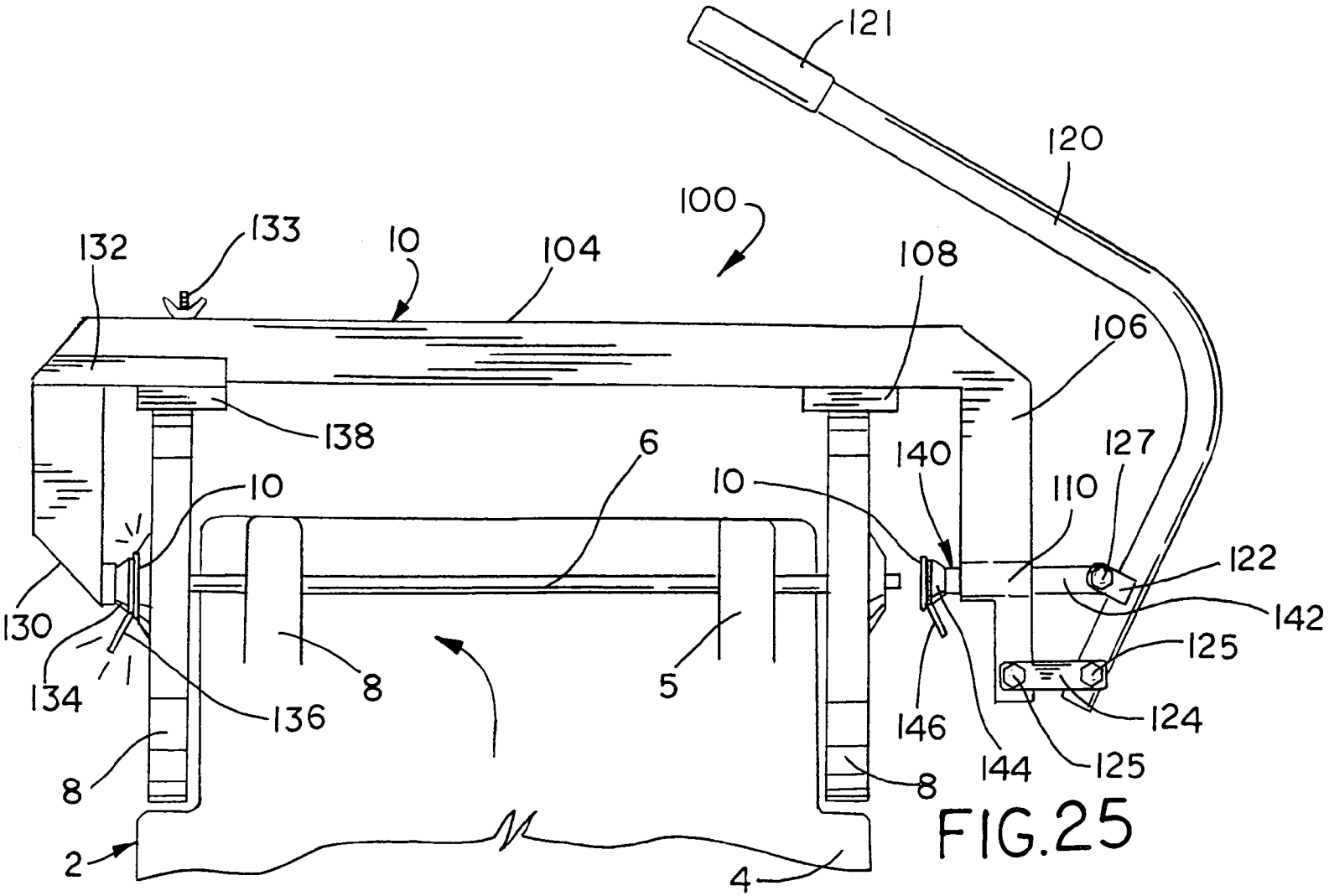
FIG. 25 is a side plan view of the hand held press tool of FIG. 21 positioned over a partially assembled rollout cart.
Figure 26:
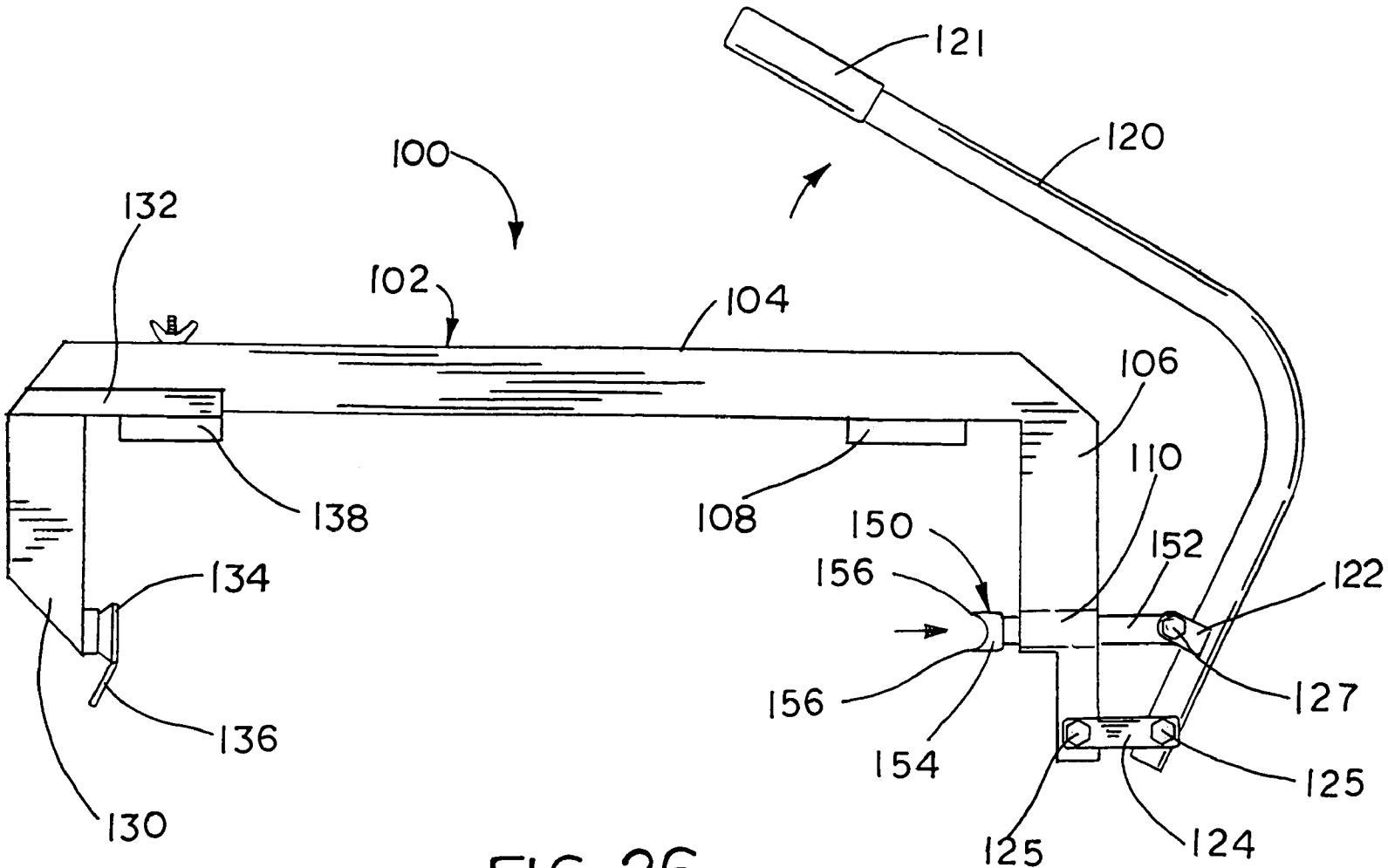
FIG. 26 is a side plan view of the hand held press tool of FIG. 21 positioned over a partially assembled rollout cart with the assembly ram extended to press the push nuts onto the axle rod.
Figure 27:
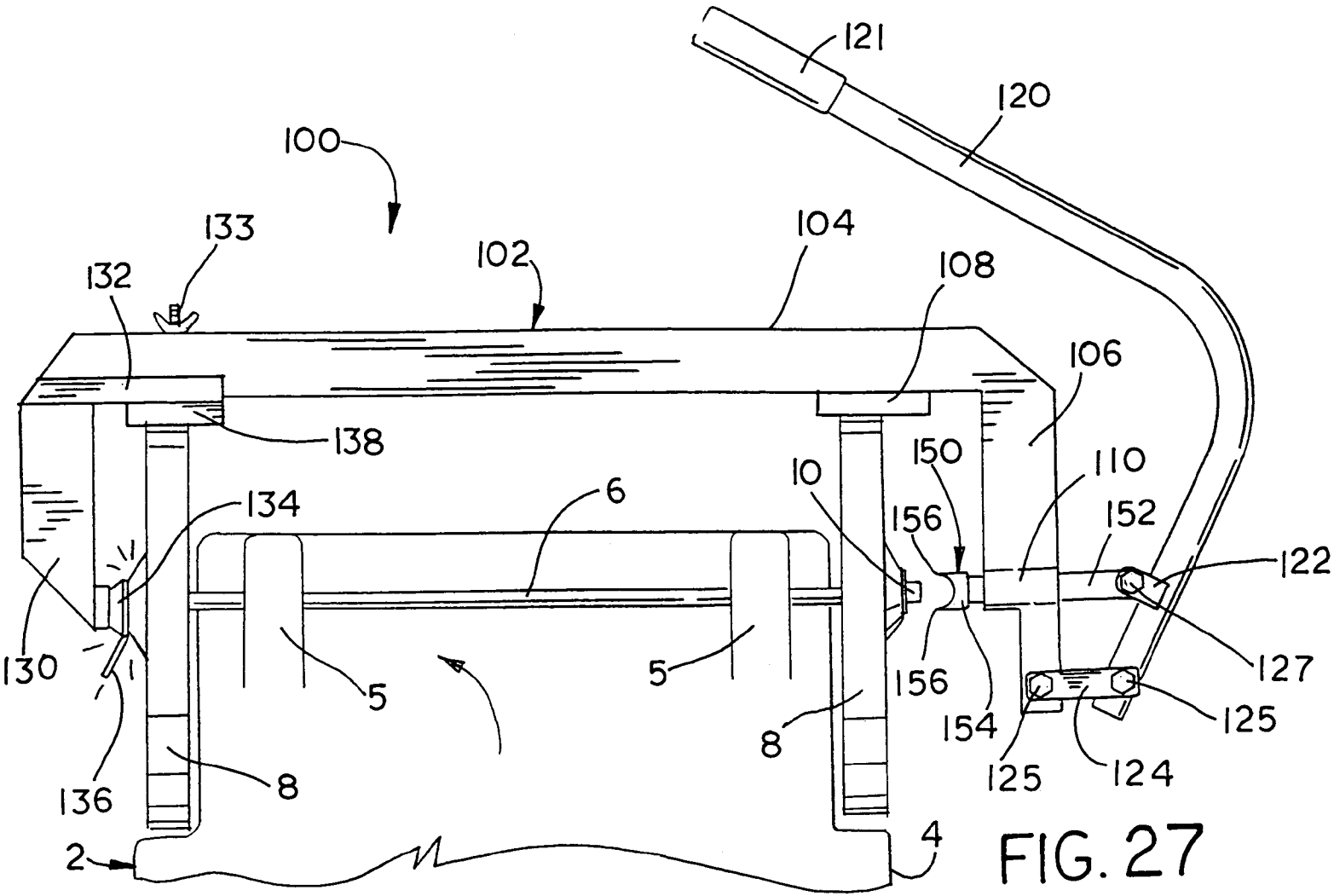
FIG. 27 is another side plan view of the hand held press tool of FIG. 21 positioned over the fully assembled rollout cart.

First, assembly ram 140 is fitted to press tool 100 and abutment part 130 is mounted to frame 102 at the proper location along frame cross member 104 to accommodate the axle length of the rollout cart being assembled (FIG. 23). Next, two push nuts 10 are inserted into push nut cups 134 and 144 (FIG. 24). With the partially assembled cart still lying on its face, press tool 100 is manually positioned over cart 2 so that wheel chocks 108 and 138 rest atop wheels 8 and push nut cup 134 abuts against one end of axle rod 6 (FIG. 25). Wheel chocks 108 and 138 rest atop wheels 8 ensure that push nut cups 134 and 144 are in axial alignment with axle rod 6. Once properly positioned on cart 2, lever 120 is depressed down toward frame cross member 104, which extends assembly ram 140 and drives both push nuts 10 onto axle rod 6 (FIG. 26). Once push nuts 10 are pressed onto axle rod 6, assembly of cart 2 is completed and the user pulls up on lever 120, which retracts assembly ram 140 and lifts press tool 100 off wheels 8 (FIG. 27).

Disassembly of cart 2, that is removal of the push nuts from the axle rod, follows a similar process. First, press tool 100 is fitted with removal ram 150. With cart 2 laid on its face, press tool 100 is positioned over cart 2 so that wheel chocks 108 and 138 rest atop wheels 8. Next, the push nut to be removed (one adjacent removal ram 150) is rotated so that its teeth 16 align with prongs 156 of removal head 154 (FIG. 28). Again as described in the prior embodiment and illustrated in FIGS. 19 and 20, when lever 120 is depressed extending removal ram 150, prongs 156 deform flange 14 of the push nuts over teeth 16, which pulls the teeth back out of engagement with axle rod 6. When lever 120 is released, press tool 100 is simply lifted from cart 2 and the deformed push nut can be pulled off the axle rod. This process can be repeated for the other push nut as necessary.

Advantages

One skilled in the art will note several advantage provided by the press tool of this invention. The press tools reduce the time and effort required to fix and remove push nuts from the axle rods of rollout carts. The ram mechanism used by both embodiments ensure that push nuts are axially pressed onto the axle rods. One or both of the push nuts can be fixed to the axle rod with a single lever push. The press tools can be operated with one hand. The press tools eliminate the use of hammers to pound the push nuts onto the axles and the use of grinders, chisels, and screw drivers to removed the push nuts. The use of the press tools make assembling wheeled rollout carts safer for the assemblers, by eliminating the dangers inherent in pounding push nuts onto axle rods with a hammer. The press tool ensures that the push nuts are squarely fixed to the axle rods resulting in high quality cart.

Both press tool embodiments use an interchangeable components so that the tools can be used for both assembly and disassembly of the rollout carts. The press tool can be converted from an assembly tool to a disassembly tool by simply changing out a ram component that is secured by simple fasteners. The floor stand press tool even provides convenient storage for the detachable components that are not in use.

The hand held press tool can be physically positioned and operated with one hand. The tubular frame construction makes the press tool light weight while providing sufficient structural strength. By grasping the handle grip, a user can both lift the press tool and actuate the ram with a single hand. The end mounted L-shaped lever and the linkage, which connects the ram to the lever, ensure that a user can both lift and position the press tool, as well as, the ram is retracted when the user lifts the press tool by the handle grip. When a user lifts the press tool, the weight of the frame creates a moment that pivots the frame about the lever to draw the ram back to its retracted position. Once the hand held press tool is seated atop the wheel of a cart, the lever can be depressed to extend the ram. When the hand held press tool is lifted off the wheel by the handle grip, the ram is automatically retracted. Consequently, no return spring is required as in the floor standing press tool.

It is understood that the above description does not limit the invention to the details given, but may be modified within the scope of the following claims.

I claim:

1. A hand held apparatus for affixing a push nut to each end of an elongated axle rod of a wheeled rollout cart, where the push nuts include a cap for receiving the end of the axle rod, an annular flange extended around the cap and a tooth formed between the cap and the flange that restrictively engages the axle rod when pressed onto the axle rod, the apparatus comprising:

an elongated frame having a first end and a second end;

an extensible ram mounted below the frame at the first end for movement between an extended position and a retracted position, an abutment part selectively mounted below the frame adjacent the second frame end at one of a plurality of discrete positions along the frame such that the abutment part is opposed to and spaced from the ram for receiving the axle rod longitudinally therebetween;

a fitting mounted to the end of the ram for receiving one of the push nuts therein;

means for reciprocating the ram from the retracted position to the extended position to axially press the push nut received in the fitting onto the axle rod longitudinally aligned between the abutment part and the ram; and a first wheel chock and a second wheel chock, each of the first wheel chock and the second wheel chock providing means for positioning and seating the apparatus atop a wheel of the cart over the axle so that the axle rod is longitudinally aligned between the ram and the abutment part, the first wheel chock mounted to the frame between the ram and the abutment part, the second wheel chock mounted to the abutment part such that the second wheel chock may be adjustably positioned relative to the first wheel chock.

2. The apparatus of claim 1 wherein each of the fittings include a cup part defining an interior therein and means disposed within the cup interior for restrictively holding the push nut cap to the cup.

3. The apparatus of claim 1 wherein the holding means includes a magnet.

4. The apparatus of claim 1 and a second fitting mounted to the abutment part for receiving a second of the push nuts therein.

5. The apparatus of claim 1 wherein the reciprocating means includes a lever arm having one end pivotally connected to the frame and the ram.

6. The apparatus of claim 5 wherein the lever arm has a handle end extending over the frame between the first frame end and the second frame end for supporting the apparatus over the cart when used to affix the push nuts to the axle rod.

* * * * *